US010036198B2

(12) United States Patent
James et al.

(10) Patent No.: US 10,036,198 B2
(45) **Date of Patent: *Jul. 31, 2018**

(54) SELF-TENSIONING MAGNETIC TRACKS AND TRACK ASSEMBLIES

(71) Applicant: Defender Screens International LLC, Bradenton, FL (US)

(72) Inventors: Arthur James, Bradenton, FL (US); Jan Gross, Sarasota, FL (US)

(73) Assignee: DEFENDER SCREENS INTERNATIONAL LLC, Bradenton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/646,223

(22) Filed: Jul. 11, 2017

(65) Prior Publication Data

US 2018/0038160 A1 Feb. 8, 2018

Related U.S. Application Data

(63) Continuation of application No. 15/227,345, filed on Aug. 3, 2016, now Pat. No. 9,719,292.

(51) Int. Cl.

| | |
|---|---|
| ***E06B 9/00*** | (2006.01) |
| ***E06B 9/58*** | (2006.01) |
| ***E06B 9/06*** | (2006.01) |
| *A47G 5/02* | (2006.01) |

(52) U.S. Cl.

CPC ..... *E06B 9/00* (2013.01); *E06B 9/0692* (2013.01); *E06B 9/58* (2013.01); *A47G 5/02* (2013.01)

(58) Field of Classification Search

CPC . E06B 9/00; E06B 9/0692; E06B 9/58; E06B 9/581; A47G 5/02

USPC ..... 160/272, 273.1

See application file for complete search history.

(56) References Cited

U.S. PATENT DOCUMENTS

| | | | | |
|---|---|---|---|---|
| 5,351,742 | A | 10/1994 | Lichy | |
| 5,479,979 | A | 1/1996 | Hayashiguchi | |
| 5,526,865 | A | 6/1996 | Coenraets | |
| 6,263,949 | B1 | 7/2001 | Guthrie, Jr. | |
| 7,360,575 | B2 | 4/2008 | Weiss | |
| 7,793,702 | B2 | 9/2010 | Biewer et al. | |
| 8,607,841 | B2 | 12/2013 | Hayashiguchi | |
| 9,719,292 | B1 * | 8/2017 | James | E06B 9/58 |

(Continued)

OTHER PUBLICATIONS

International Search Report for PCT/US2017/038417 dated Jul. 18, 2017 (7 pages).

*Primary Examiner* — Blair M Johnson
(74) *Attorney, Agent, or Firm* — Christopher A. Proskey

(57) ABSTRACT

A magnetic track assembly including an elongate channel having an open side, an end wall, and two parallel side walls; a first magnet disposed within the elongate channel near an interior side of the end wall; a compartment defined within the elongate channel spaced from the first magnet; and a screen receiver disposed within the compartment and including a second magnet arranged facing the first magnet. In the magnetic track assembly, the first and second magnets are of opposite polarity and the screen receiver is loosely disposed within the compartment such that a magnetic bond is intact between the first and second magnets when the first and second magnets are close together and the magnetic bond is broken when the first and second magnets are pulled apart.

15 Claims, 9 Drawing Sheets

(56) References Cited

U.S. PATENT DOCUMENTS

| | | | |
|---|---|---|---|
| 2006/0137836 | A1 | 6/2006 | Harbison |
| 2015/0041076 | A1 | 2/2015 | Andre de la Porte |

* cited by examiner

SELF-TENSIONING MAGNETIC TRACKS AND TRACK ASSEMBLIES

CROSS REFERENCE TO RELATED APPLICATIONS

This Application is a Continuation Application claiming priority from U.S. Non-Provisional patent application Ser. No. 15/227,345 filed on Aug. 3, 2016, which is incorporated by reference herein in their entirety.

TECHNICAL FIELD

The present invention relates generally to the field of tracks and track assemblies for retractable screens, and more particularly, to self-tensioning magnetic tracks and track assemblies for motorized retractable screens.

BACKGROUND

Over the past two decades, motorized retractable screens have gained popularity due to their utility and versatility for temporarily enclosing spaces. For example, many restaurants and other businesses having patios/outdoor areas utilize retractable screens to temporarily enclose these areas thereby creating environmentally controlled areas that are shielded from inclement weather conditions (e.g., windy and/or cold weather conditions).

While these retractable screens have great versatility and utility, several problems exist with the currently marketed screens and tracks/track assemblies. For example, the currently marketed tracks and track assemblies are fixed tracks that maintain the screen in a tight, aesthetically pleasing manner once the screen has been deployed. Although these fixed tracks/track assemblies maintain the screen in a tight, aesthetically pleasing manner, these fixed tracks allow for very little play (e.g., expansion and/or contraction) of the screen during, for example, high wind conditions. Consequently, during high wind conditions, these screens may (1) twist, buckle, and/or warp the fixed tracks/track assemblies, (2) damage the screen, or (3) any combination thereof. These problems lead to frequent, costly repairs and/or replacement of the fixed tracks/track assemblies and screens.

SUMMARY

Therefore, it is an object of the invention to provide tracks and track assemblies that overcome the problems of currently marketed fixed tracks and fixed track screen assemblies. The disclosed tracks and track screen assemblies overcome these problems by utilizing a self-tensioning magnet arrangement that allows for expansion and contraction of a screen/shade attached thereto. When compared to currently marketed fixed tracks and fixed track screen assemblies, this self-tensioning magnet arrangement advantageously results in less frequent maintenance of the disclosed tracks/track assemblies while simultaneously increasing screen lifespan.

The disclosed tracks and track assemblies, for example, utilize a novel arrangement of magnets in the track assemblies that allow a screen attached thereto to expand while under high wind pressure/conditions. Specifically, in the disclosed track and track assemblies, magnets having opposite polarity separate from one another allowing for screen expansion while subjected to high wind pressure. However, after the high wind pressure subsides, the magnetic attraction of the separated magnets pulls the separated magnets into close proximity relative to one another while concurrently tensioning the screen to provide for an aesthetically pleasing, tight screen.

As another advantage and in direct contrast to the currently marketed fixed tracks and fixed track assemblies, the disclosed tracks and track assemblies do not have dimensional limitations of screens that can be used in these tracks/track assemblies, and screens covering extremely wide and tall openings, including dimensions of up to 30 feet wide by 24 feet high, may be used with the disclosed tracks and track assemblies.

Specifically disclosed is a magnetic track assembly including an elongate channel having an open side, an end wall, and two parallel side walls; a first magnet disposed within the elongate channel near an interior side of the end wall; a compartment defined within the elongate channel spaced from the first magnet; and a screen receiver disposed within the compartment and including a second magnet arranged facing the first magnet, wherein the first and second magnets are of opposite polarity and the screen receiver is loosely disposed within the compartment such that a magnetic bond is intact between the first and second magnets when the first and second magnets are close together and the magnetic bond is broken when the first and second magnets are pulled apart.

In certain aspects, the screen receiver includes an elongate C-shaped channel opening in a direction opposite the first magnet such that the C-shaped channel is accessible through the open side of the elongate channel. The screen receiver, and more particularly the C-shaped channel opening, are in certain aspects adapted to receive a screen interlock including, but not limited to a keder interlock, a zipper interlock, a rope, a beaded chain, or any similar interlock known in the art associated with the disclosed retractable screens.

In certain aspects, the compartment is defined by interior partition walls that extend inward from their respective one of the two parallel sidewalls, and wherein each of the partition walls extend inward a distance less than half a distance between the two parallel side walls.

In certain aspects, the second magnet is outside of the compartment when the magnetic bond between the first and second magnets is intact, and within the compartment when the bond between the first and second magnets is broken.

In certain aspects, a width of the screen receiver is less than a width of the compartment such that the screen receiver can be installed at an angle through the open side of the elongate channel.

In certain aspects, the elongate channel further includes a secondary channel disposed along one of the two parallel side walls opening in a direction perpendicular to the open side of the elongate channel.

In certain aspects, the magnetic track assembly further includes a removable elongate cover covering a length of the secondary channel.

In certain aspects, the elongate channel is open at a top and a bottom thereof, and wherein the top and the bottom are covered with removable top and bottom covers, respectively.

In certain aspects, the interior compartment has a depth greater than one inch and up to, for example, 2 inches, 3 inches, 4 inches, 5 inches, 6 inches, or 7 inches.

Also disclosed herein is a magnetic track assembly including an elongate channel having an open side, an end wall, and two parallel side walls; a first magnet disposed within the elongate channel near an interior side of the end wall; a compartment defined within the elongate channel spaced from the first magnet; a screen receiver disposed within the compartment, the screen receiver comprising a C-shaped channel opening in a direction of the open side of the elongate channel, and a second magnet arranged facing the first magnet; and a screen tensioner slidably received within the C-shaped channel; wherein the first and second magnets are of opposite polarity and the screen receiver is loosely disposed within the compartment such that a magnetic bond is intact between the first and second magnets when the first and second magnets are close together and the magnetic bond is broken when the first and second magnets are pulled apart.

In certain aspects, the screen receiver is adapted to move horizontally within the compartment toward and away from the first magnet.

In certain aspects, the compartment is defined by interior partition walls that extend inward from their respective one of the two parallel sidewalls, and wherein each of the partition walls extend inward a distance less than half a distance between the two parallel side walls.

In certain aspects, a width of the screen receiver is less than a width of the compartment such that the screen receiver can be installed at an angle through the open side of the elongate channel.

In certain aspects, the elongate channel further includes a secondary channel disposed along one of the two parallel side walls opening in a direction perpendicular to the open side of the elongate channel.

In certain aspects, the magnetic track assembly further includes a removable elongate cover covering a length of the secondary channel.

In certain aspects, the elongate channel is open at a top and a bottom thereof, and wherein the top and the bottom are covered with removable top and bottom covers, respectively.

In certain aspects, the interior compartment has a depth greater than one inch and up to, for example, 2 inches, 3 inches, 4 inches, 5 inches, 6 inches, or 7 inches.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Disclosed are magnetic tracks and track assemblies that utilize a novel magnet arrangement in the track assemblies that allow magnets to separate thereby allowing an attached screen to expand while under high wind pressure, and after the high wind pressure subsides, magnetic attraction of these separated magnets pulls the separated magnets into close proximity relative to one another thereby tensioning the attached screen to provide an aesthetically pleasing, tight screen. Thus, the novel magnet arrangement of the disclosed magnetic tracks/track assemblies provide a "self-tensioning" system that operates effectively while accounting for fluctuations in weather conditions that advantageously ensures increased screen and track assembly lifespan while currently reducing frequent maintenance (and/or replacement) associated with currently marketed screens, track/track assemblies, or a combination thereof.

Figure 1:
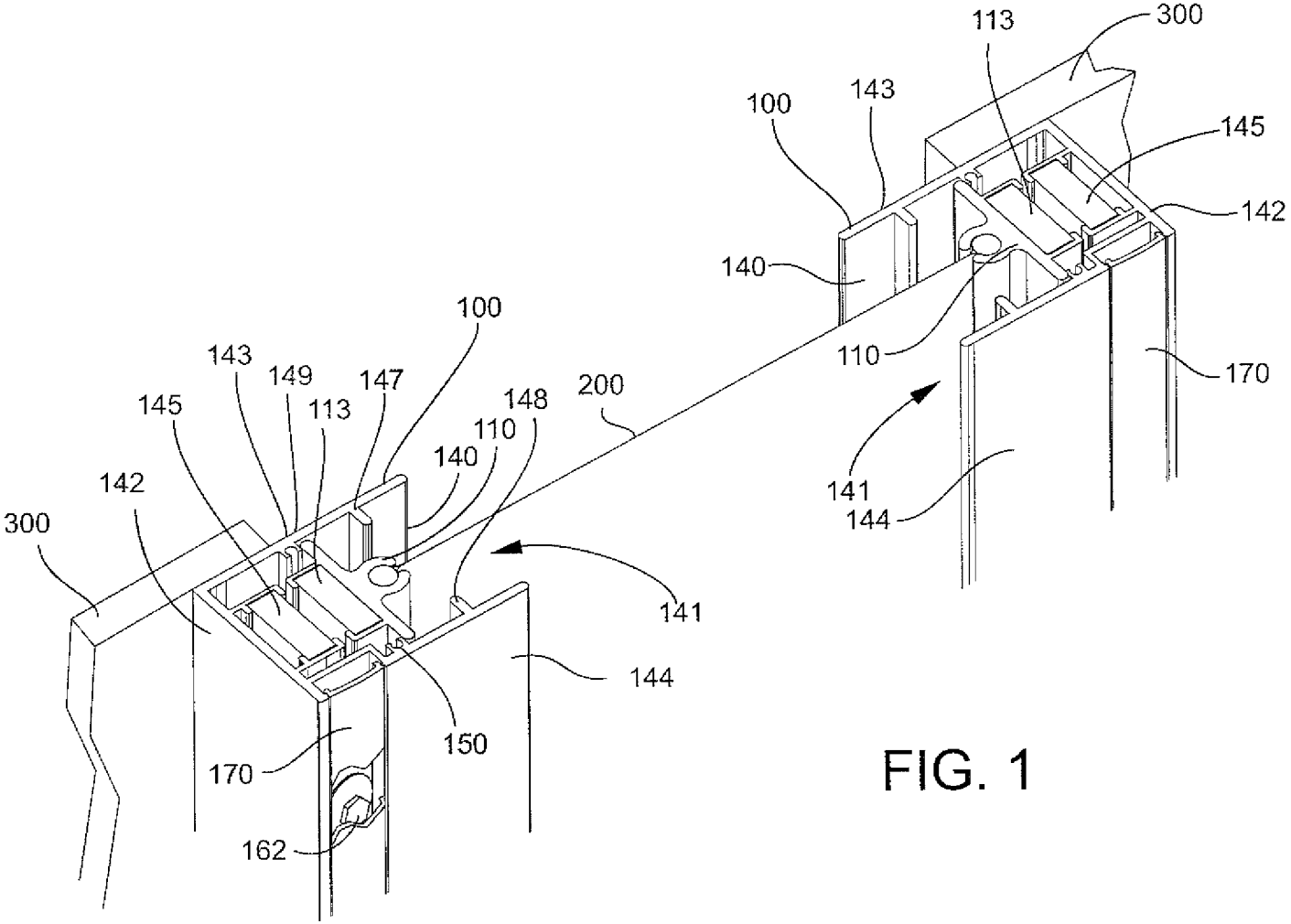
FIG. 1 is a perspective view of the assembled magnetic track assembly having a motorized, retractable screen attached thereto in which the screen has a tight, aesthetically pleasing appearance.

Exemplary magnetic tracks/track assemblies 100 are depicted, for example, in FIGS. 1-8. For example, FIG. 1 depicts a perspective view of two assembled magnetic track assemblies 100 having a parallel arrangement respective to one another with a motorized, retractable screen 200 positioned between and attached to each assembly. The motorized, retractable screen 200 is readily deployed and retracted between the two magnetic track assemblies while, in certain preferred aspects, all portions of the assembly remain vertically stationary during screen deployment and retraction. The magnetic track assembly 100 further has sufficient length to extend vertically along a column or a doorway to ensure that the screen 200 may vertically span the entire length of the column or doorway 300 thereby creating a temporarily enclosed space when the screen is deployed.

Figure 2:
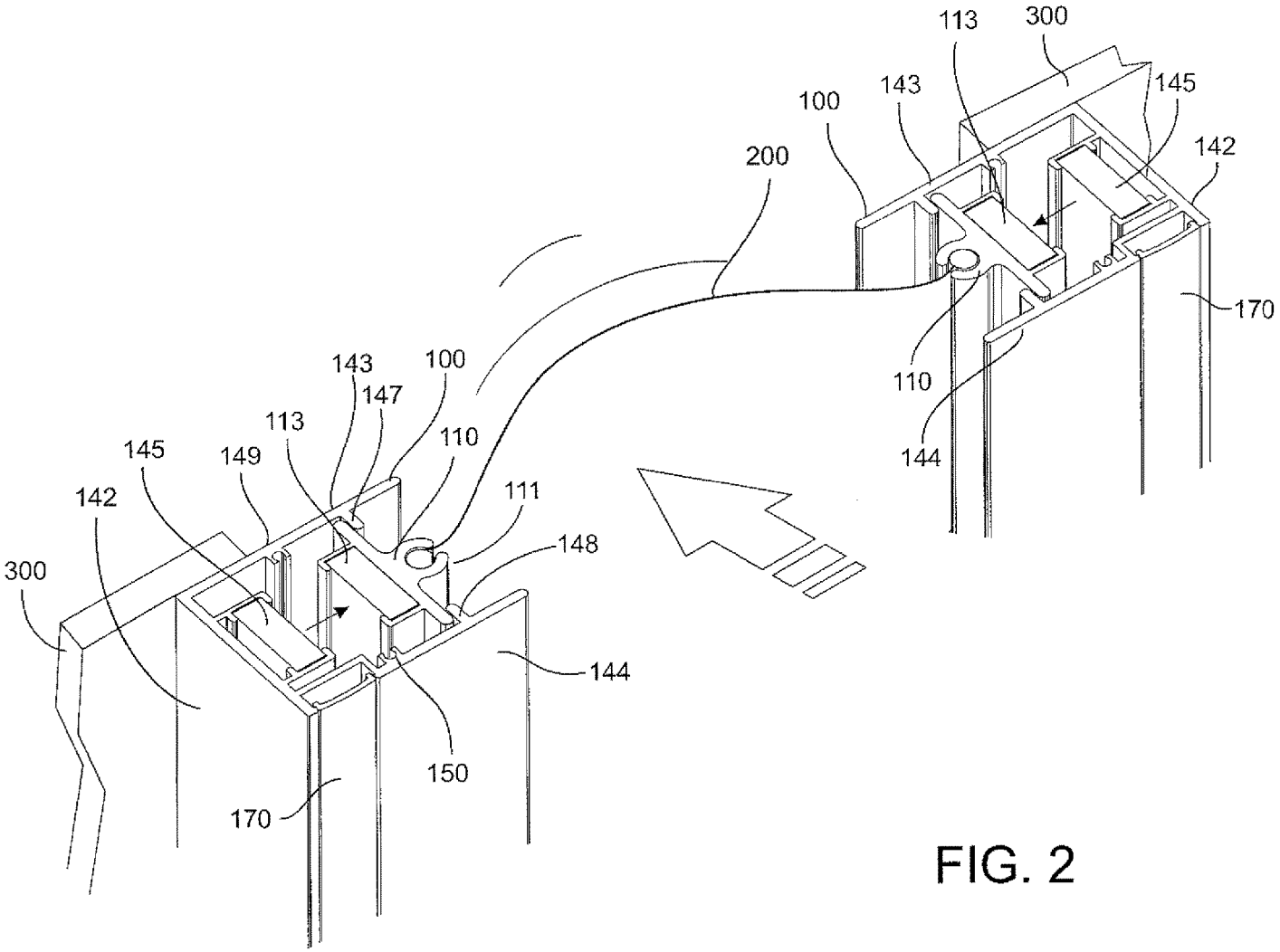
FIG. 2 further depicts the magnetic track assembly and a motorized, retractable screen of FIG. 1 during inclement weather in which the magnets of each assembly separate allowing the screen to expand.

FIG. 2 shows a perspective view of FIG. 1 further demonstrating the novel magnet arrangement that provides the above discussed "self-tensioning" system when the magnets 113, 145 are separated from one another during, for example, inclement weather conditions. As shown in FIGS. 1 and 2, the magnetic track assembly 100 includes a screen receiver 110 and an elongate channel 140 having an open side 141, an end wall 142, and two parallel side walls 143, 144. The elongate channel 140 further includes a magnet 145 having a predetermined polarity attached to the interior of its end wall 142 and a compartment 146 formed by a plurality of partitions 147, 148, 149, 150 that extend inwardly towards the interior of the elongate channel. The compartment 146 is adapted to securely receive the removable screen receiver 110 while allowing for movement therein.

Figure 6:
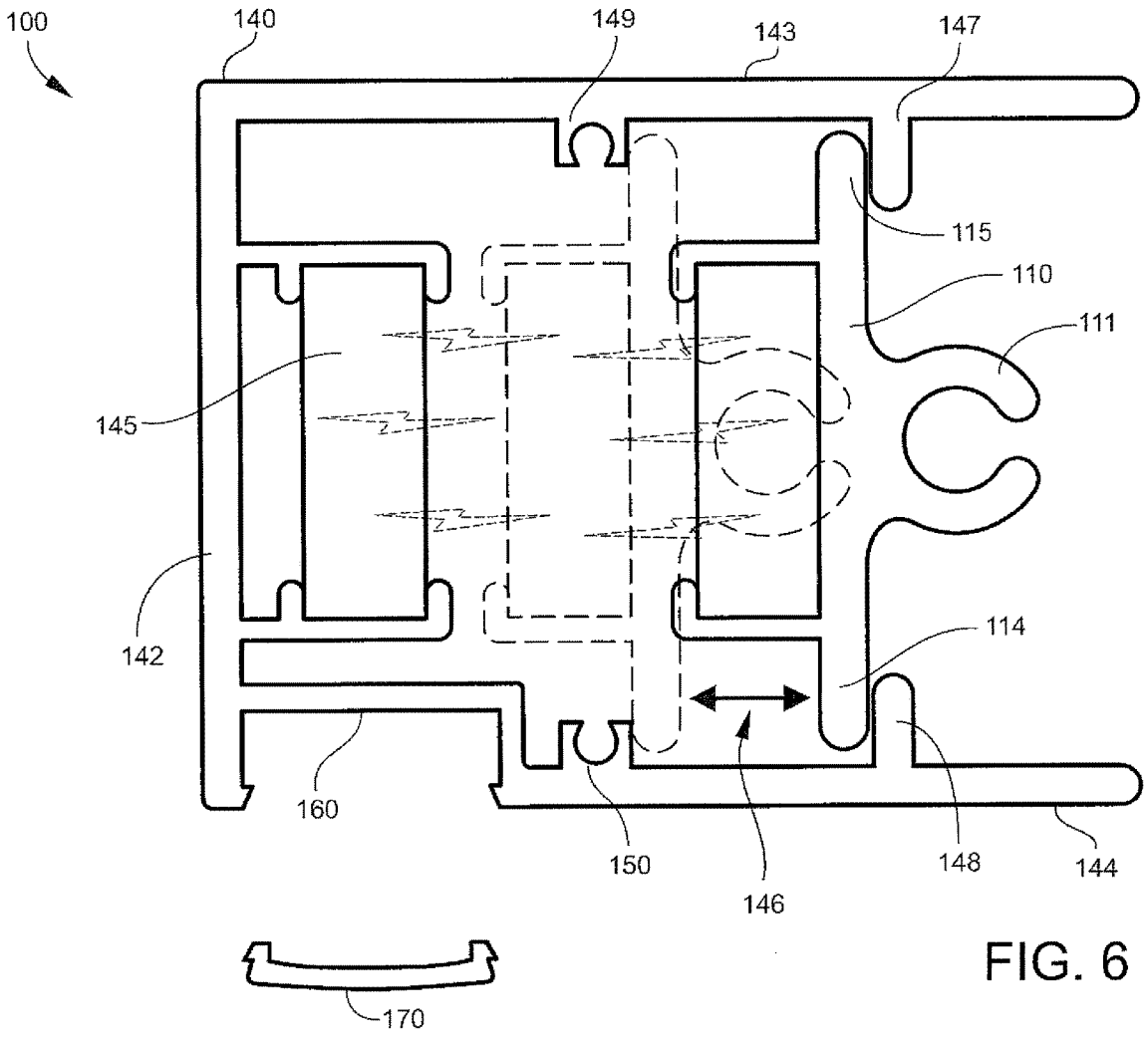
FIG. 6 is a top view of the magnetic track assembly showing the screen receiver including a magnet arranged thereon positioned in the compartment of the elongate channel.
Figure 7:
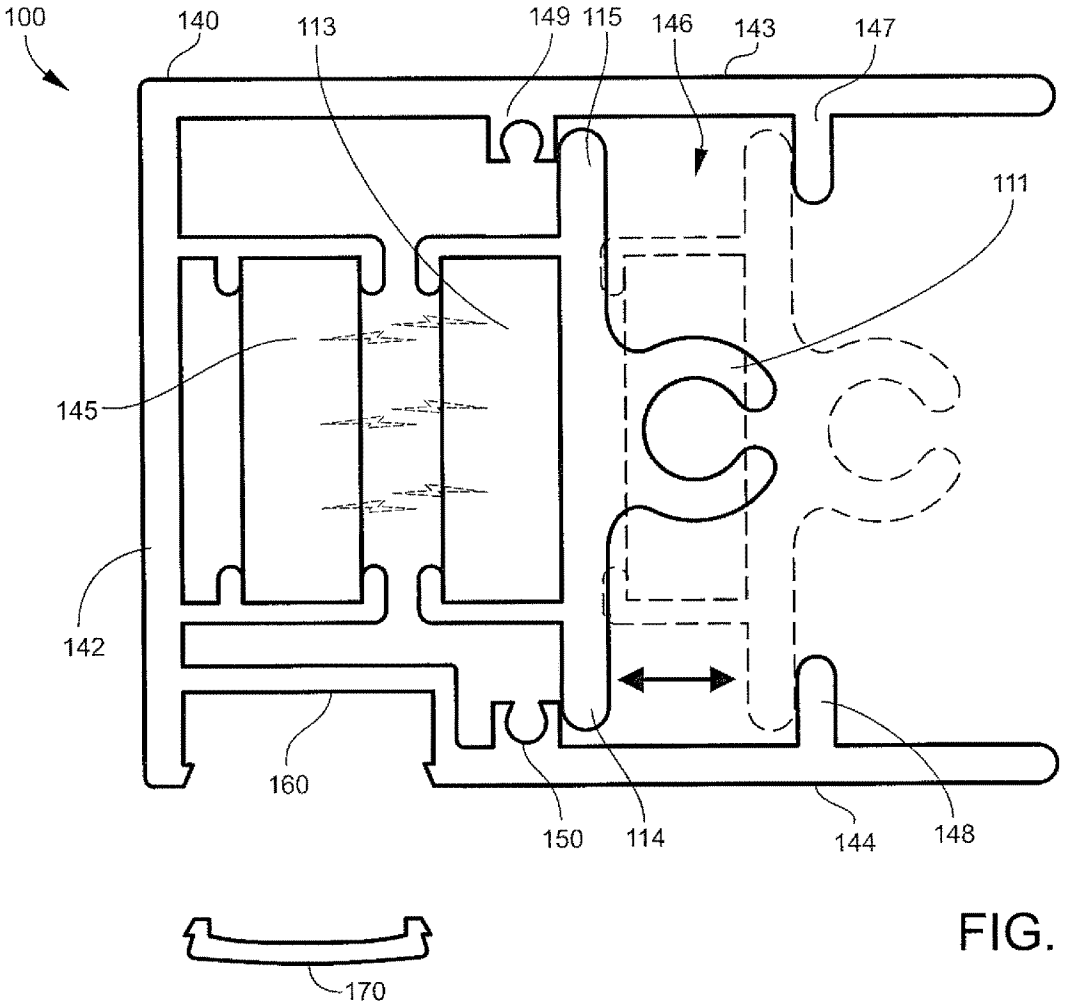
FIG. 7 is a top view of the magnetic track assembly showing the screen received positioned in the compartment of the elongate channel and the magnet arranged on the screen receiver extending beyond the compartment in a direction towards a magnet arranged on an end wall of the elongate channel.

As further shown in FIGS. 1 and 2, the screen receiver 110 is adapted to receive a screen 200 on one side of the receiver while having a magnet 113 arranged on an opposite side. For example, in certain aspects, the screen receiver 110 includes a C-shaped channel 111 formed thereon that receives the screen 200 (e.g., a screen keder interlock, a zipper interlock, a rope, a beaded chain, or any similar interlock known in the art) while providing sufficient clearance such that the screen may easily move through the C-shaped channel—the screen being easily deployed and retracted as desired through the C-shaped channel. On a side 112 opposite the C-shaped channel, the screen receiver includes a magnet 113 arranged thereon having an opposite polarity of magnet 145 attached to the interior of end wall 142. The screen receiver 110 is preferably adapted to be removably positioned in the compartment 146 of the elongate channel 140 such that magnet 113 of the screen receiver and magnet 145 arranged on the interior of end wall 142 are in close proximity and attract one another, thereby creating a magnetic bond when the magnets are in close proximity, as shown in FIGS. 1 and 7, but the magnetic bond is temporarily broken when the magnets are separated/pulled apart, as shown, for example, in FIGS. 2 and 6.

For example and as shown in FIG. 1, when the track assemblies 100 are fully assembled and have a screen 200 attached there between, for example, two track assemblies, screen 200 is pulled tight (i.e., has a tight, aesthetically pleasing look) when magnets 113, 145 of the assembly are in close proximity and have an intact magnetic bond. However, as shown in FIG. 2, during inclement weather (e.g., high wind conditions), the screen receiver 110 is configured to move within compartment 146 allowing the magnetic bond between magnets 113, 145 to be broken in one or both screen assemblies, thereby allowing for screen expansion. Once the inclement weather subsides (e.g., high wind conditions), magnets 113, 145 of each assembly are arranged in close enough proximity such that the opposite magnetic polarities attract one another, thus once again pulling the screen tight 200 between the two assemblies, thus providing the screen with a tight, aesthetically pleasing look.

Figure 3:
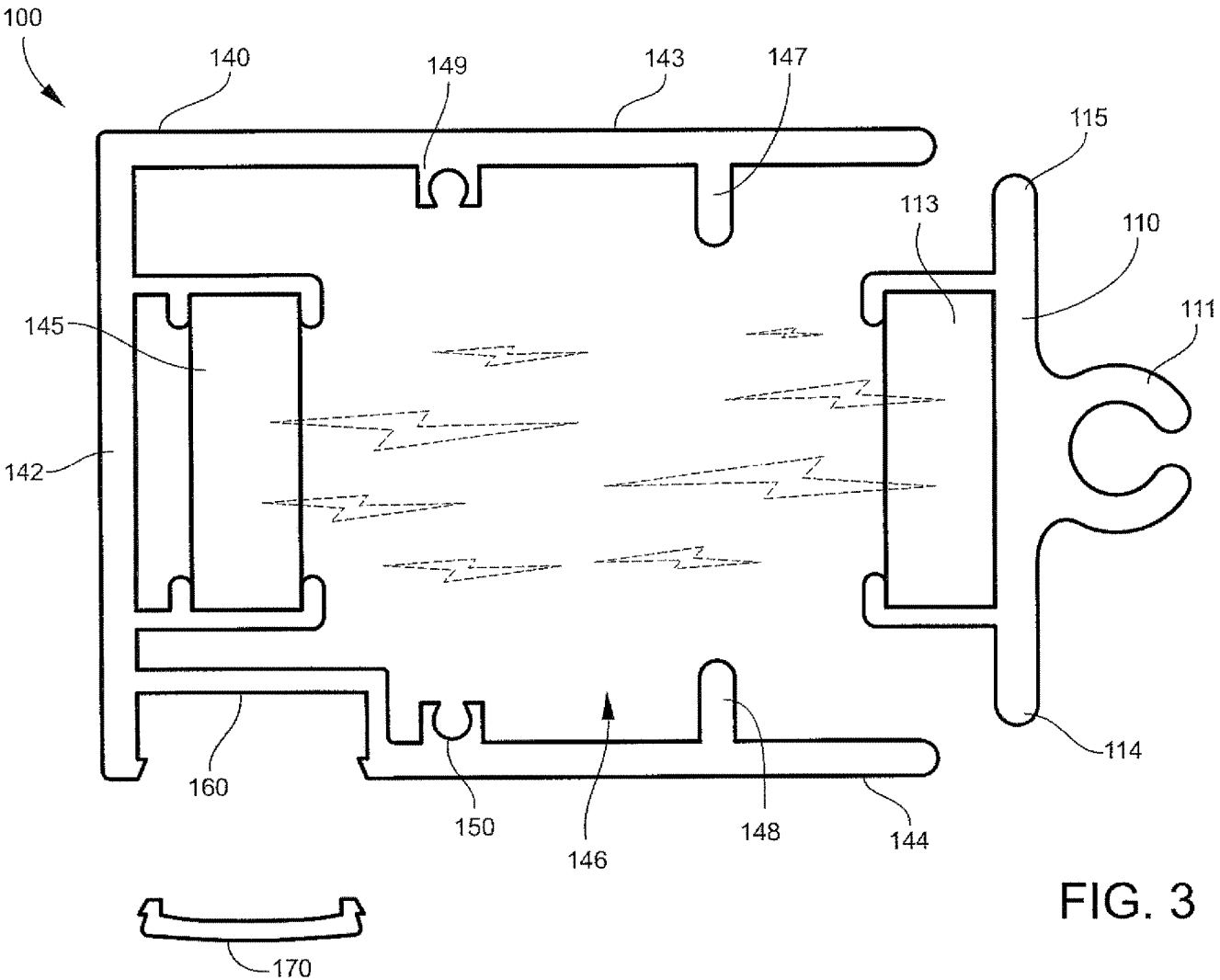
FIG. 3 is a top view of the magnetic track assembly showing the screen receiver outside of the opening of the elongate channel.

FIGS. 3-8 depict sequential views of assembling the magnetic track assembly 100 by positioning the screen receiver 110 in the elongate channel 140, and once assembled, how the screen receiver may laterally move in compartment 146, vertically move, or a combination thereof in the elongate channel 140 during inclement weather. FIG. 3 specifically depicts a top view of the magnetic track assembly 100 in which the screen receiver 110 and elongate channel 140 are two separate components. As shown, in a disassembled state, the screen receiver 110 is initially outside of the elongate channel 140, but during assembly of the magnetic track assembly 100, the screen receiver 110 is securely (but removably) positioned in the elongate channel.

Figure 4:
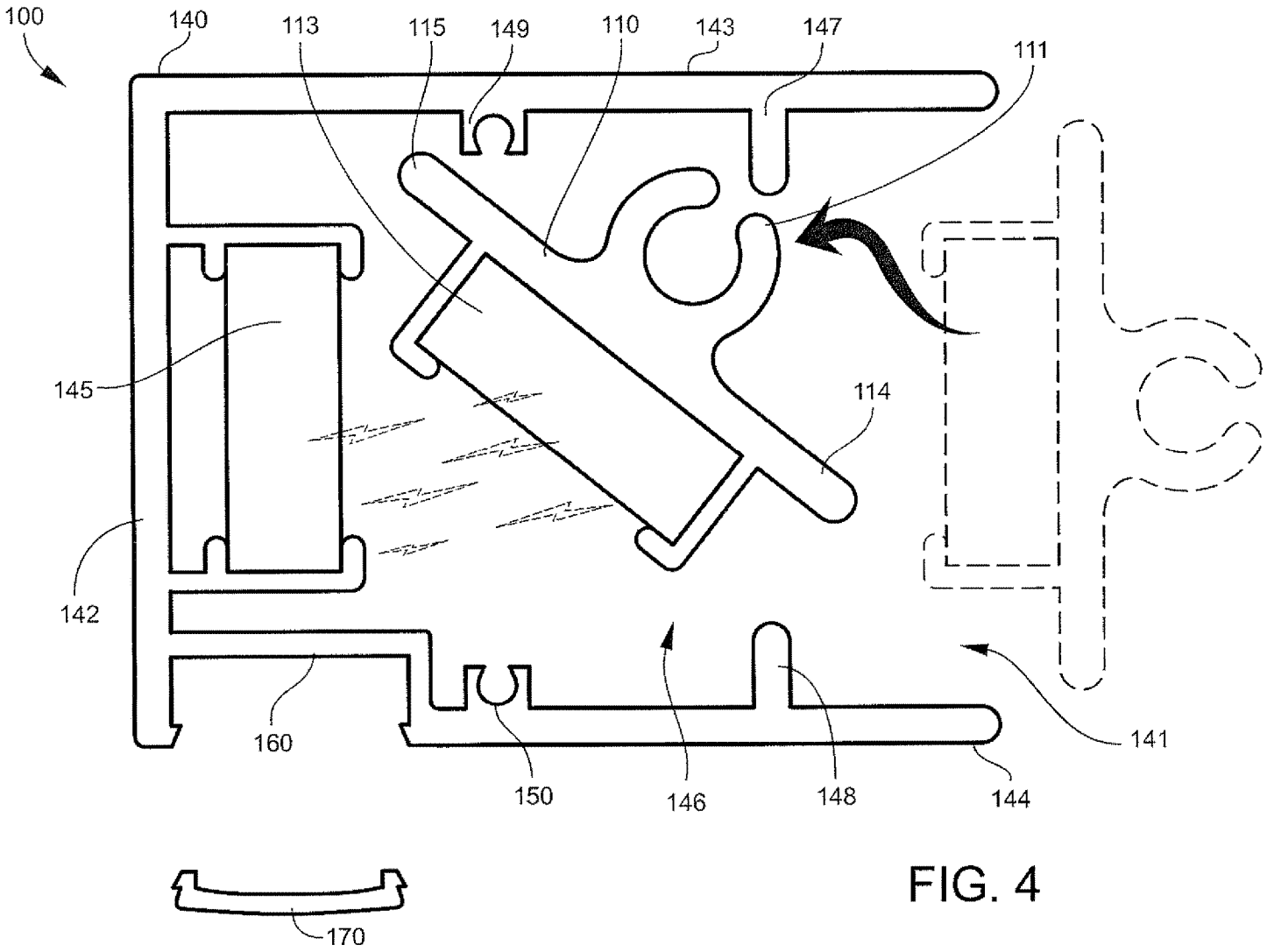
FIG. 4 is a top view of the magnetic track assembly showing the screen receiver being positioned inside the elongate channel.

As shown in FIG. 4, the screen receiver 110 is positioned in the compartment 146 of the elongate channel 140 by initially turning the screen receiver at an angle (e.g., diagonally) relative to the two parallel side walls 143, 144 of the elongate channel. Next, the screen receiver 110 is advanced inside the elongate channel 140 in a direction towards the magnet 145 arranged on the interior of end wall 142. As further shown in FIG. 4, one end 115 of the screen receiver is advanced beyond the end of the compartment 146 nearest to end wall 142 while the opposite end 114 of screen receiver remains outside of the opposite end of the compartment 146 nearest to the opening 141 of the elongate channel.

Figure 5:
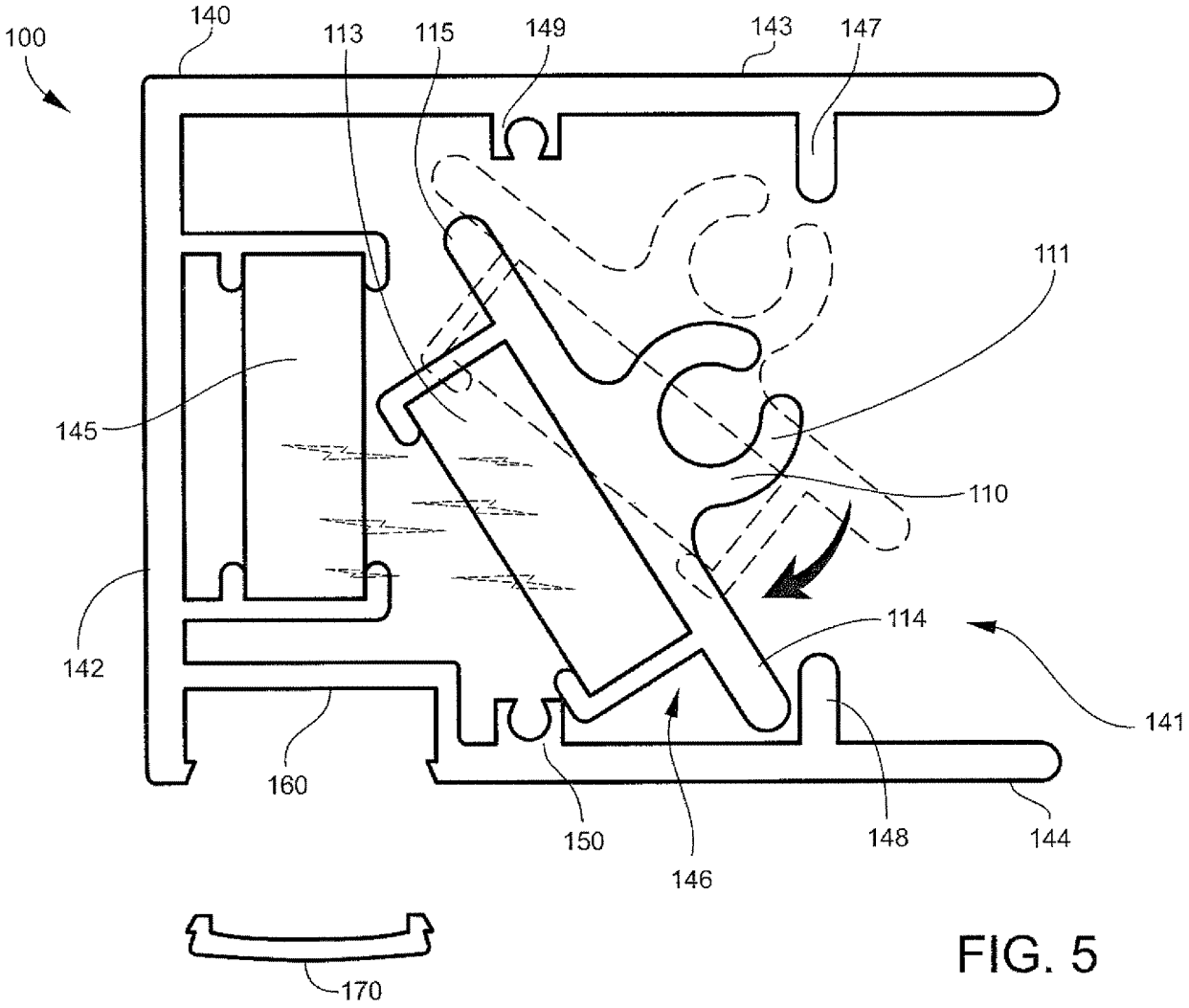
FIG. 5 is another top view of the magnetic track assembly showing the screen receiver being positioned and moved within the elongate channel.

Next and as further shown in FIG. 5, the screen receiver 110 is advanced in the compartment and moved such that end 114 of the screen receiver is positioned within the compartment 146 and is adjacent relative to partition 148 and parallel side wall 144 thereby securing end 114 of the screen receiver in the compartment. As shown in FIGS. 5 and 6, sufficient clearance exists between end 115 of the screen receiver and partition 149 of parallel side wall 143 to adjust the screen receiver 110 and secure the screen receiver 110 in the compartment 146. As shown in FIGS. 6 and 7, when the screen receiver 110 is secured in compartment 146, ends 114, 115 of screen receiver 110 are preferably parallel relative to the partitions 147, 148, 149, 150 that form compartment 146. In certain aspects, the partitions extend inward less than half a distance between the two parallel side walls 143, 144.

As further shown in FIGS. 6 and 7, clearance exists between ends 114, 115 of screen receiver and each corresponding parallel side wall 143, 144 to allow lateral movement (horizontal movement) of the screen receiver 110 between the parallel side walls 143, 144. As further shown in FIGS. 6 and 7, the screen receiver 110 may also move between partitions 147, 148 (front partitions of compartment) and partitions 149, 150 (back partitions) within compartment 146 in a direction extending from end wall 142 to opening 141 (and vice versa). For example, FIG. 7 specifically depicts the magnet 113 of the screen receiver 110 being in close proximity to magnet 145 arranged on end wall 142 such that a magnetic bond is intact between the magnets. When having this arrangement and having a screen 200 received through the screen receiver 110, the screen would be pulled tight having a tight, aesthetically pleasing look. As further shown in FIG. 7, when the magnets 113, 145 are in close proximity such that the magnetic bond is intact, the magnet 113 arranged on the screen receiver is outside of the compartment 146 extending in a direction towards the interior of end wall 142.

However, as shown in FIGS. 2 and 6, the magnetic bond between magnets 113, 145 may be broken, for example, during inclement weather. For example, when a screen 200 is received through screen receiver 110, the screen is allowed to "expand" during, for example, inclement weather including high wind conditions. As shown in FIGS. 2 and 6 in view of FIG. 7, during high wind conditions, the screen 200 may apply force to the screen receiver 110 such that the magnetic bond between the magnets 113, 145 is broken and the screen receiver moves within the compartment in a direction away from end wall 142 towards the opening 141 of the elongate channel. As further shown in FIG. 6, when the magnetic bond is broken, magnet 113 arranged on screen receiver 110 is temporarily in compartment 146, and in certain aspects, ends 114, 115 of the screen receiver 110 may contact the partitions 147, 148 of the compartment nearest the opening 141 of elongate channel thereby securely remaining in the compartment. Thus, in view of the above disclosures, FIGS. 6 and 7 demonstrate how screen receiver 110 moves within compartment 146 thereby allowing for screen expansion during inclement weather conditions and screen contraction/tightening once the inclement weather subsides.

Figure 8:
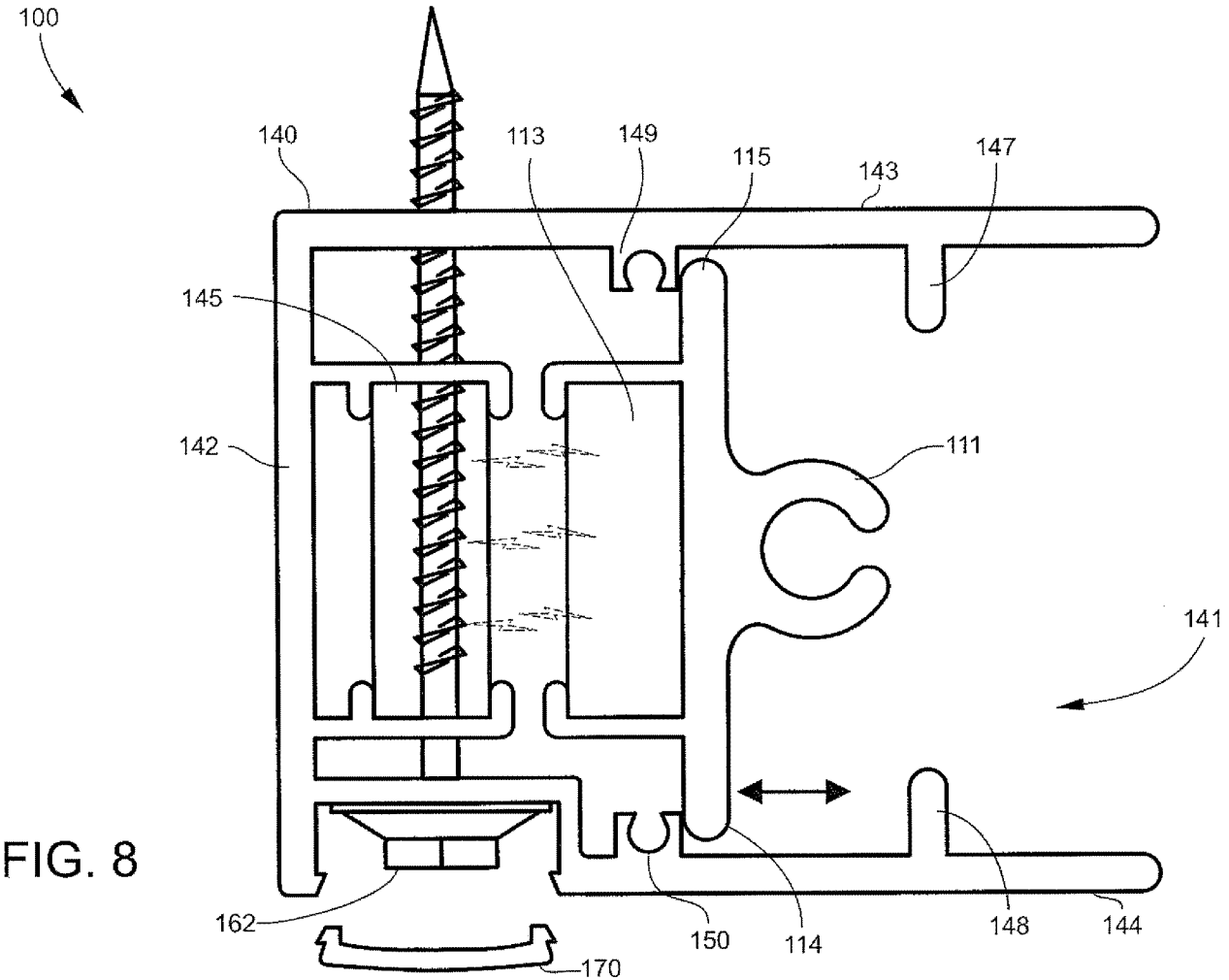
FIG. 8 is the top view of FIG. 7 further showing a fastener extending through the parallel side walls of the elongate channel for attaching the magnetic track assembly to a desired surface.

As further shown in FIGS. 1 and 8, the magnetic track assembly 100, and more specifically the elongate channel 140, may be permanently fixed to a vertical structure 300 such as a column or a doorway. For example, elongate channel 140 may include a plurality of through holes 161 on each parallel side wall in which a through hole on one side wall 144 is aligned with a complimentary through hole on the second side wall 143. The through holes allow the elongate channel 140 to be permanently fixed to a vertical structure by advancing a fastener 162 (e.g., a screw) through the aligned through holes into the vertical structure 300, thereby fixing the elongate channel 140 to the vertical structure 300. As further depicted in FIGS. 3-8, in certain aspects, the elongate channel 140 includes a secondary channel 160 disposed along one 144 of the two parallel side walls opening in a direction perpendicular to the open side 141 of the elongate channel 140. The secondary channel 160 forms a recess having through holes arranged thereon that are aligned with through holes on the other parallel side. After advancing the fastener 162 through the through holes, the fastener head is fully disposed within the recess formed by the secondary channel 160 and preferably does not extend beyond the outermost surface of the parallel side wall 144 on which the secondary channel is formed. As further shown in FIG. 8, the magnetic track assembly 100 further includes a removable elongate cover 170 that fits with the secondary channel 160 to conceal the fastener head in the secondary channel. In certain aspects, the elongate cover 170 extends the entire length of the secondary channel and may be configured for a snap fit, interference fit, or sliding engagement with the secondary channel 160.

Figure 9:
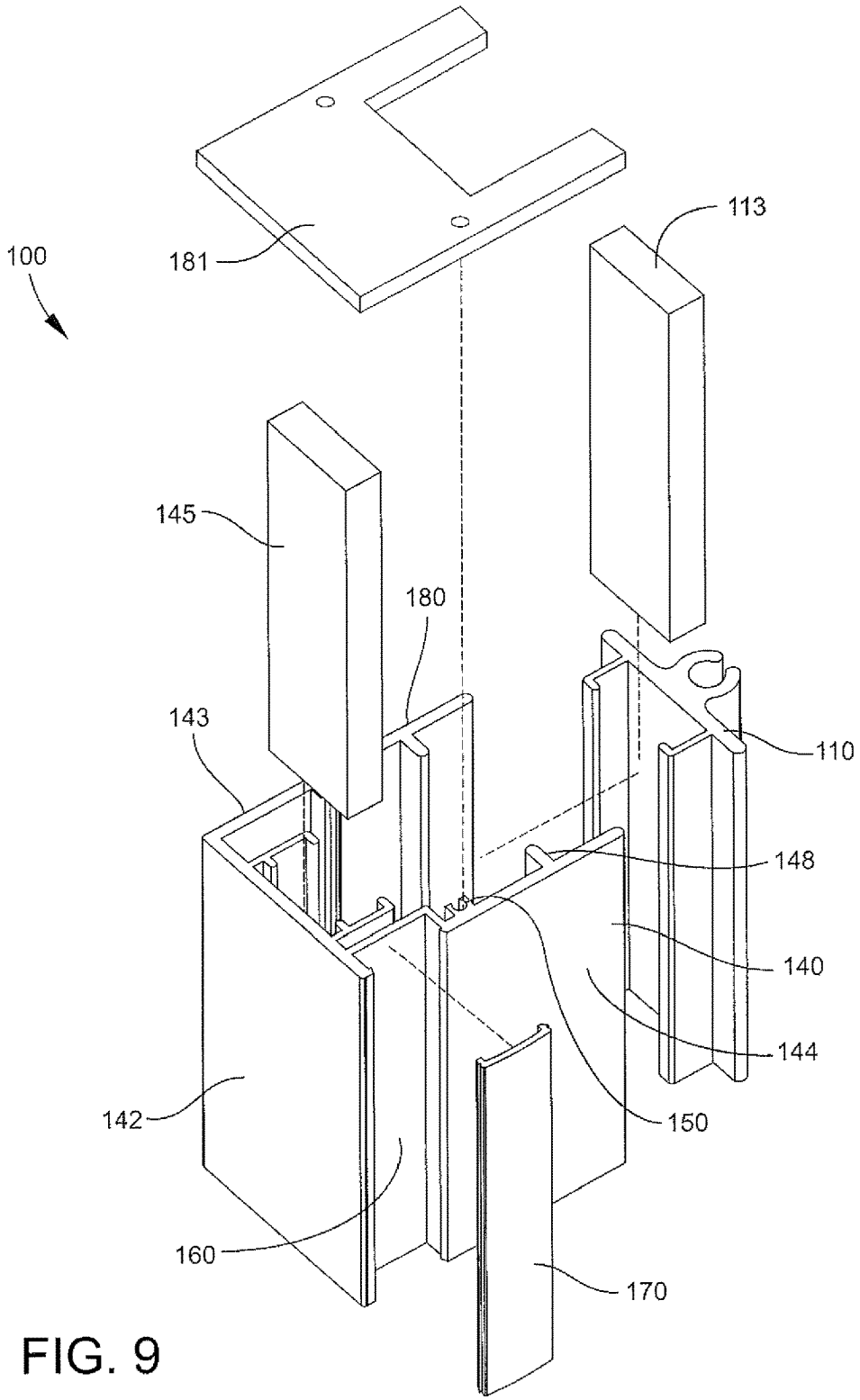
FIG. 9 depicts an exploded view of the magnetic track assembly.

FIG. 9 depicts an exploded view of the magnetic track assembly 100. To provide the magnetic track assembly 100 with a more aesthetically pleasing look, top end 180 and/or bottom end (not shown) may be covered with top cover 181 and bottom cover (not shown), respectively. For example, as shown in any of FIG. 9, through holes may be formed on, for example, partitions 149, 150 of the compartment 146. These through holes extend parallel relative to one another along the longitudinal axis of the elongate channel 140. In certain aspects, top cover 181 is fastened to the top 180 of the elongate channel after positioning the screen receiver therein, and top cover 181 may further secure screen receiver in the elongate channel while concurrently restricting vertical movement of the screen receiver 110 in the elongate channel. As further shown in FIG. 9, in certain aspects, top cover 181 includes recessed/cut out portions that align with an end of the screen receiver such that the screen received in the screen receiver does not contact the top cover. This arrangement allows the screen to be easily deployed and retracted without contacting the top cover.

The screen receiver 110, the elongate channel 140, elongate cover 170, and/or top cover 181 (and bottom cover) may be formed of metal, a thermoplastic resin, or a combination thereof. For example, in certain aspects, the screen receiver 110, the elongate channel 140, elongate cover 170, and/or top cover 181 (and bottom cover) may be formed of a molded thermoplastic/thermoplastic resin sufficient to withstand harsh weather conditions and the movements disclosed herein.

It should be further noted that the screen receiver 110 disclosed herein may be adapted to receive a screen keder through, for example, a C-shaped channel 111. However, the screen receiver 110 may have any desired predetermined shape (e.g., triangular, square, rectangular shape) that can receive screen 200 there through. As alluded to above, the screen receiver 110 may be adapted to receive a zipper interlock, a rope, a beaded chain, or any similar interlock known in the art associated with the disclosed retractable screens.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A magnetic track assembly, comprising:

an elongate channel having an open side, an end wall, and two parallel side walls;

a first magnet disposed within the elongate channel near an interior side of the end wall;

a compartment defined within the elongate channel spaced from the first magnet; and a screen receiver disposed within the compartment and including a second magnet arranged facing the first magnet;

wherein the screen receiver is loosely disposed within the compartment such that a magnetic bond is intact between the first and second magnets when the first and second magnets are close together and the magnetic bond is broken when the first and second magnets are pulled apart, wherein:

the compartment is defined by interior partition walls that extend inward from their respective one of the two parallel sidewalls, and wherein each of the partition walls extend inward a distance less than half a distance between the two parallel side walls.

2. The magnetic track assembly of claim 1, wherein the screen receiver comprises an elongate channel opening having a predetermined shape in a direction opposite the first magnet such that the channel is accessible through the open side of the elongate channel.

3. The magnetic track assembly of claim 1, wherein the second magnet is outside of the compartment when the magnetic bond between the first and second magnets is intact, and within the compartment when the bond between the first and second magnets is broken.

4. The magnetic track assembly of claim 1, wherein a width of the screen receiver is less than a width of the compartment such that the screen receiver can be installed at an angle through the open side of the elongate channel.

5. The magnetic track assembly of claim 1, wherein the elongate channel further comprises a secondary channel disposed along one of the two parallel side walls opening in a direction perpendicular to the open side of the elongate channel.

6. The magnetic track assembly of claim 5, further comprising a removable elongate cover covering a length of the secondary channel.

7. The magnetic track assembly of claim 1, wherein the elongate channel is open at a top and a bottom thereof, and wherein the top and the bottom are covered with removable top and bottom covers, respectively.

8. The magnetic track assembly of claim 1, wherein the interior compartment has a depth greater than one inch.

9. A magnetic track assembly, comprising:

an elongate channel having an open side, an end wall, and two parallel side walls;

a first magnet disposed within the elongate channel near an interior side of the end wall;

a compartment defined within the elongate channel spaced from the first magnet;

a screen receiver disposed within the compartment, the screen receiver comprising a channel opening in a direction of the open side of the elongate channel, and a second magnet arranged facing the first magnet; and a screen tensioner slidably received within the channel opening of the screen receive;

wherein the screen receiver is disposed within the compartment such that a magnetic bond is intact between the first and second magnets when the first and second magnets are close together and the magnetic bond is broken when the first and second magnets are pulled apart, wherein:

a width of the screen receiver is less than a width of the compartment such that the screen receiver can be installed at an angle through the open side of the elongate channel.

10. The magnetic track assembly of claim 9, wherein the screen receiver is adapted to move horizontally within the compartment toward and away from the first magnet.

11. The magnetic track assembly of claim 10, wherein the compartment is defined by interior partition walls that extend inward from their respective one of the two parallel sidewalls, and wherein each of the partition walls extend inward a distance less than half a distance between the two parallel side walls.

12. The magnetic track assembly of claim 10, wherein the elongate channel further comprises a secondary channel disposed along one of the two parallel side walls opening in a direction perpendicular to the open side of the elongate channel.

13. The magnetic track assembly of claim 12, further comprising a removable elongate cover covering a length of the secondary channel.

14. The magnetic track assembly of claim 10, wherein the elongate channel is open at a top and a bottom thereof, and wherein the top and the bottom are covered with removable top and bottom covers, respectively.

15. The magnetic track assembly of claim 10, wherein the interior compartment has a depth greater than one inch.

* * * * *